United States Patent [19]

Ottinger

[11] Patent Number: 4,569,177

[45] Date of Patent: Feb. 11, 1986

[54] BRIDGING SYSTEM FOR STEEL JOISTS

[75] Inventor: Jim A. Ottinger, Texarkana, Tex.

[73] Assignee: Tex-Ark Joist Company, Hope, Ark.

[21] Appl. No.: 580,427

[22] Filed: Feb. 15, 1984

[51] Int. Cl.[4] ..... E04H 12/00

[52] U.S. Cl. ..... 52/650; 52/721; 52/694

[58] Field of Search ..... 52/721, 665, 664, 694, 52/650, 648, 690, 693

[56] References Cited

U.S. PATENT DOCUMENTS

| | | | |
|---|---|---|---|
| 2,412,778 | 12/1946 | Kosek | 52/694 |
| 3,196,993 | 7/1965 | Holloman | 52/721 |
| 3,421,280 | 1/1969 | Attwood et al. | 52/648 |
| 4,106,256 | 8/1978 | Cody | 52/694 |
| 4,349,996 | 9/1982 | Lautensleger | 52/693 |
| 4,438,616 | 3/1984 | Codd | 52/655 |

FOREIGN PATENT DOCUMENTS

| | | | |
|---|---|---|---|
| 400502 | 4/1966 | Switzerland | 52/665 |

*Primary Examiner*—John E. Murtagh
*Assistant Examiner*—Kathryn L. Ford
*Attorney, Agent, or Firm*—Michael A. O'Neil

[57] ABSTRACT

A bridging system (50) for steel joists (56) comprises fasteners (52) secured to the chords (54) of the steels joists (56) by welding. Bridging members (60) comprise the lengths of angle iron having fastener receiving holes (62) formed therein at equally spaced intervals. Selected fastener receiving holes (62) of the bridging members (60) are engaged with the fasteners (52), and the bridging members (60) are mechanically retained in engagement with the fasteners (52). The fasteners (52) may comprise steel dowels, in which case the bridging members (60) are retained by retaining rings (74), or threaded members, in which case the bridging members (60) are retained by nuts (76) threadedly engaged with the fasteners (52).

20 Claims, 7 Drawing Figures

BRIDGING SYSTEM FOR STEEL JOISTS

TECHNICAL FIELD

This invention relates generally to bridging systems for steel joists, and more particularly to a bridging system which does not require the use of welding.

BACKGROUND AND SUMMARY OF THE INVENTION

Large buildings such as schools, wholesale and retail establishments, manufacturing plants, etc. are often fabricated utilizing steel joists. The joists are extended between the walls of the building, or between girders which extend between the walls, and support either a higher floor of the building or the building roof. Typically, the joists are in turn interconnected by transversely extending rods or angle irons in a procedure known as "bridging".

Heretofore, bridging systems for steel joists have required the use of welding. In accordance with the usual procedure, the steel joists are positioned in the building and the transversely extending rods or angle irons are then secured to each joist by means of welding. This procedure is unsatisfactory for at least two reasons. First, expensive welding equipment must be maintained at the job site throughout the construction process, thereby increasing construction costs. Second, welding operations must be performed by skilled, highly paid laborers, thereby further increasing construction costs.

Another problem which is inherent in the practice of present bridging procedures involves the fact that in many instances the design of the building requires the precise positioning of the bridging members relative to the joists. When the bridging members are installed in the field, it is impossible from any practical standpoint to insure that the bridging members will be properly placed. Problems of this nature are frequently encountered when the design of the bridging system involves the positioning of bridging members at unequal intervals.

The present invention comprises a bridging system for steel joists which overcomes the foregoing and other problems long since associated with the prior art. In accordance with the broader aspects of the invention, fasteners are secured to the joists at the time of manufacture. This is highly advantageous in that the location of the component parts of the bridging system is under the control of the joist manufacturer, rather than construction personnel.

After the joists are installed, preformed bridging members are extended between adjacent joists and are secured thereto. The bridging members are secured to the fasteners and therefore to the joists mechanically, rather than by welding. This is higly advantageous in that it eliminates both the necessity of providing welding equipment at the job site and the necessity of utilizing skilled labor to construct the bridging system.

In accordance with more specific aspects of the invention, the bridging members are preferably perforated at spaced apart intervals, and are therefore adapted for universal application regardless of joist spacing. The bridging members may be provided with additional sets of perforations to facilitate the installation of bracing members therebetween. The fasteners that are secured to the joists may be threaded, in which case nuts are used to secure the bridging members in place. Alternatively, the fasteners may comprise steel dowels, in which case retaining rings are used to secure the bridging members in place.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
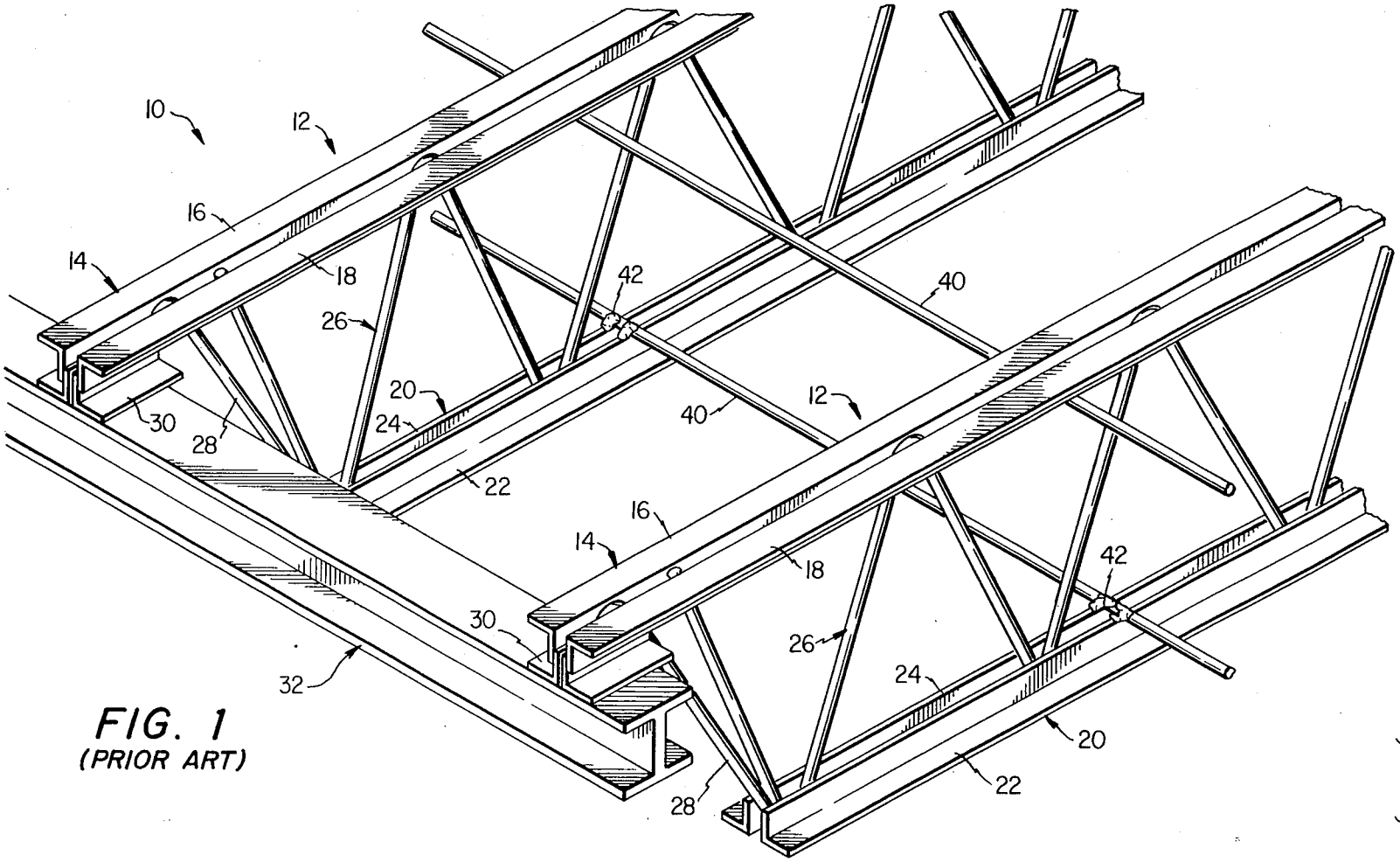
FIG. 1 (PRIOR ART)
FIG. 1 is an illustration of a prior art bridging system.

Referring now to the Drawings, and particularly to FIG. 1, there is shown a prior art bridging system 10. The bridging system 10 is utilized in conjunction with a plurality of conventional steel joists 12. Each joist 12 includes a top chord 14 comprising a pair of spaced apart angle irons 16 and 18 and a bottom chord 20 likewise comprising a pair of spaced apart angle irons 22 and 24. A web 26, which may comprise one or more sections, extends between the angle iron 16 and 18 comprising the top chord 14 and between the angle irons 22 and 24 comprising the bottom chord 20 and is secured in place by welding. Each end of the joist 12 is provided with an end bar 28 which is also welded in place between the angle irons comprising the top chord 14 and the bottom chord 20. In the particular joists 12 illustrated in FIG. 1, the webs 26 and the end bars 28 are formed from steel rods, however, it will be understood that the webs and end bars may also be formed from lengths of angle iron, if desired.

The joists 12 are provided with suitable support structure. For example, each end of each joist 12 may be provided with a bearing plate 30 comprising short lengths of angle iron which are secured to the top chord 14 by welding. The function of the bearing plates 30 is to secure the joists 12 to suitable support structure 32. Techniques for securing joists of the types shown in FIG. 1 to various types of support structure are well known in the art.

The bridging system 10 comprises bridging members 40 which extend transversely between the joists 12. Although the particular bridging members 40 shown in FIG. 1 comprise steel rods, the use of angle irons as bridging members is also known. As is shown at 42, the bridging members 40 are secured to the joists 12 by welding. The bridging members 40 may be welded either to the webs or to the chords comprising the joists 12. Bridging systems of the type shown in FIG. 1 are presently used almost universally to form connections between steel joists. Nevertheless, bridging systems wherein the bridging members are welded to the joists exhibit two major problems. First, it is necessary to maintain expensive welding equipment at the job site throughout the construction process. Second, it is necessary to employ skilled laborers to form the welded connections between the bridging members and the joists. Both of these requirements lead to increased construction costs.

Figure 2:
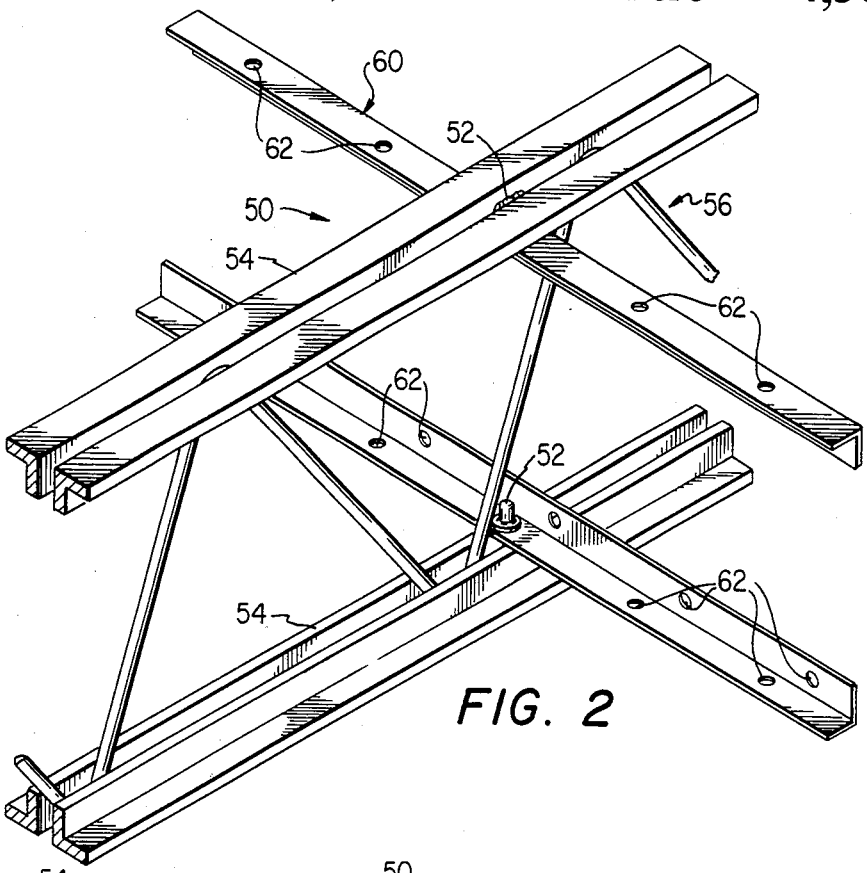
FIG. 2 is a perspective view illustrating the bridging system of the present invention.
Figure 3:
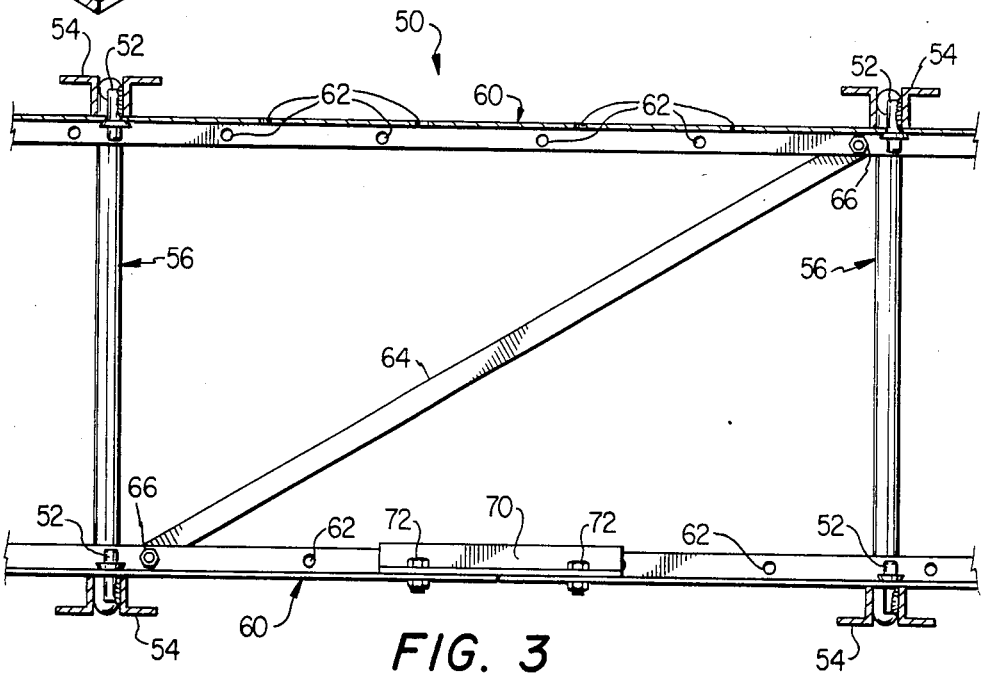
FIG. 3 is a sectional view further illustrating the bridging system of FIG. 2.

Referring now to FIGS. 2 and 3, there is shown a bridging system for steel joists 50 incorporating the present invention. In accordance with the bridging system 50, fasteners 52 are secured to the chords 54 of a plurality of steels joists 56 at the time the joists 56 are manufactured. Bridging members 60 comprise lengths of angle iron having fastener receiving holes 62 formed therein. After the joists 56 are installed in a building, selected fastener receiving holes 62 of the bridging members 60 are engaged with the fasteners 52 of the joists 56, and are mechanically secured thereto. In this manner the entire bridging system 60 is installed without the necessity of any welding steps whatsoever.

The spacing between the fastener receiving holes 62 of the bridging members 60 may be selected to fulfill the requirements of particular applications of the invention. However, since the spacing between steel joists usually comprises multiples of one foot, the fastener receiving hole 62 of the bridging members 60 are preferably located at one foot intervals. In this manner the bridging members 60 are adapted for universal application, and it is therefore unnecessary to stock various types of bridging members.

The fastener receiving holes 62 are preferably formed in both legs of the lengths of angle iron comprising the bridging members 60. As is best shown in FIG. 3, this practice facilitates the connection of bracing members 64 between the bridging members 60. The bracing members 64 are secured in place by conventional threaded fasteners 66 which are received through selected fastener receiving holes 62 of the bridging members 60 and corresponding fastener receiving holes formed in the opposite ends of the bracing members 64.

FIG. 3 also illustrates a splice plate 70 which may be utilized to connect adjacent bridging members 60. The splice plate 70 comprises a short length of angle iron having fastener receiving holes formed therethrough which are positioned at the same intervals as the fastener receiving holes 62 of the bridging members 60. The splice plate 70 is secured in place by means of conventional threaded fasteners 72 which are received through fastener receiving holes 62 situated at the ends of the adjacent bridging members 60 and the fastener receiving holes of the splice plate 70.

Figure 4:
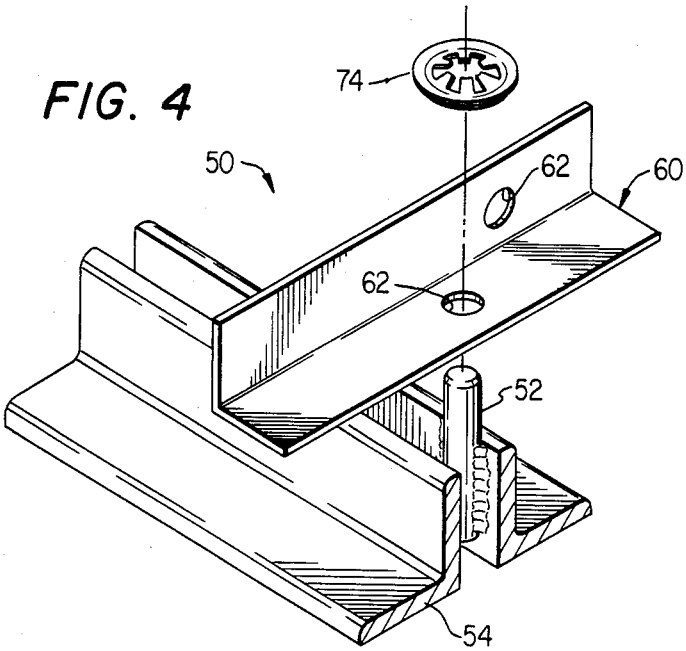
FIG. 4 is an illustration of a first embodiment of the invention.

FIG. 4 illustrates a first embodiment of the bridging system 50. In accordance with the first embodiment, the fasteners 52 comprise lengths of steel dowel which are secured to the chords 54 of the joists 56 by welding. The bridging members 60 are secured to the fasteners 52 by means of retaining rings 74 which are engaged with the fasteners 52 following the engagement of selected fastener receiving holes 62 therewith. The retaining rings 74 are preferably of the type sold under the trademark "TRUARC", and identified as External Series 5115.

Figure 5:
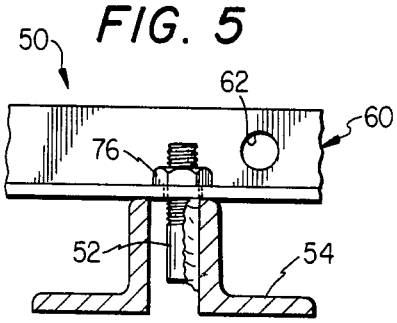
FIG. 5 is an illustration of a second embodiment of the invention.

A second embodiment of the bridging system 50 is illustrated in FIG. 5. In accordance with the second embodiment, the fasteners 52 have threaded distal ends, and are secured to the chords 54 of the joists 56 by welding. The bridging members 60 are secured to fasteners 52 of the type shown in FIG. 5 by means of conventional nuts 76.

Figure 6:
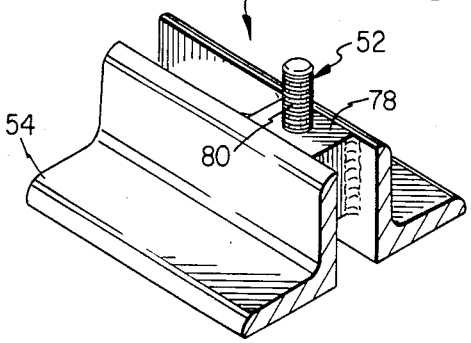
FIG. 6 is an illustration of a third embodiment of the invention.

A third embodiment of the bridging system is shown in FIG. 6. In accordance with the third embodiment, each fastener 52 includes a block 78 having a dimension matched to the spacing of the two angle irons comprising the chords of the joists 56. Conveniently, each block 78 may have a width dimension matched to the angle irons comprising the chords 54 of relatively small joists, and a length dimension matched to the spacing between the angle irons comprising the chords 54 of relatively large joists. A threaded shaft 80 extends from each block 78. The bridging members 60 are secured to fasteners 52 of the type shown in FIG. 6 by means of conventional nuts which are threadedly engaged with the threaded shafts 80.

Figure 7:
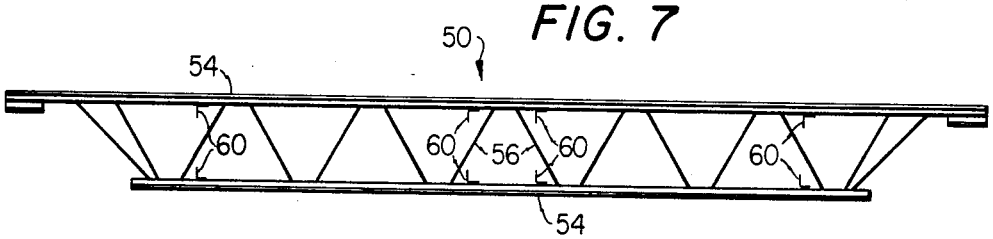
FIG. 7 is an illustration of a feature of the invention, wherein bridging members are spaced at unequal intervals along steel joists.

FIG. 7 illustrates a highly advantageous feature of the invention. In accordance with some building designs, the spacing between adjacent bridging members 60 is unequal. Since the fasteners 52 of the present invention are installed at the time that the joists 56 are manufactured, construction personnel are forced to install the bridging members at the proper spacing intervals. Any attempt to do otherwise is virtually impossible, first because the fasteners 52 cannot be relocated, and second because an omission of one of the bridging members 60 is obvious upon even a casual visual inspection.

Although preferred embodiments of the invention have been illustrated in the accompanying Drawings and described in the foregoing Detailed Description, it will be understood that the invention is not limited to the embodiments disclosed but is capable of numerous rearrangements, modifications, and substitutions of parts and elements without departing from the spirit of the invention.

I claim:

1. A method of bridging between steel joists including the steps of:

securing a plurality of fasteners at predetermined positions along the lengths of a plurality of steel joists at the time the joists are manufactured;

subsequently installing the steel joists having the fasteners secured thereto at a building location;

forming a plurality of fastener receiving holes in each of a plurality of bridging members;

engaging the fastener receiving holes of the bridging members with the fasteners secured to the steel joists; and mechanically securing the bridging members in engagement with the fasteners of the steel joists.

2. The method according to claim 1 wherein the step of forming fastener receiving holes in bridging members is characterized by forming fastener receiving holes at regularly spaced intervals in a plurality of angle irons.

3. The method according to claim 2 further characterized by forming fastener receiving holes in both legs of each of the angle irons, and including the additional step of connecting bracing members between bridging members secured to the steel joists.

4. The method according to claim 1 wherein the step of securing fasteners to steel joists is further characterized by securing a plurality of steel dowels to the steel joists, and wherein the step of mechanically securing the bridging members to the fasteners is carried out by engaging retaining rings with the steel dowels.

5. The method according to claim 1 wherein the step of securing fasteners to the steel joists is carried out by securing threaded fasteners to the steel joists, and wherein the step of securing the bridging members to the fasteners is carried out by threadedly engaging nuts with the threaded fasteners.

6. The method according to claim 1 wherein the fasteners are secured to the steel joists at unequal intervals longitudinally therealong.

7. A method of bridging between steel joists of the type including top and bottom chords and webs extending between the top and bottom chords including the steps of:

securing a plurality of fasteners at predetermined positions along the lengths of the top chords and the bottom chords of each of the steel joists at the time the joists are manufactured;

subsequently installing the steel joists having the fasteners secured thereto at a building location;

forming a plurality of fastener receiving holes at equally spaced intervals in each of a plurality of bridging members;

engaging the fastener receiving holes of the bridging members with the fasteners secured to the chords of the steel joists; and mechanically securing the bridging members in engagement with the fasteners.

8. The method of bridging according to claim 7 wherein the fasteners are secured to the chords of the steel joists by welding.

9. The method of bridging according to claim 8 wherein the step of forming fastener receiving holes in a plurality of bridging members is carried out by forming fastener receiving holes in a plurality of angle irons.

10. The method of bridging according to claim 9 wherein the step of securing the bridging members to the fasteners is carried out by means of retaining rings engaged with the fasteners.

11. The method of bridging according to claim 9 wherein the step of securing the bridging members with the fasteners is carried out by threadedly engaging nuts with the fasteners.

12. In combination with a plurality of steel joists each having top and bottom chords and a web extending therebetween, a bridging system comprising:

a plurality of fasteners secured at predetermined positions along the lengths of the top chords and the bottom chords of each of the steel joists at the time the joists are manufactured;

a plurality of bridging members each having fastener receiving holes formed therein at equally spaced intervals;

selected fastener receiving holes of each bridging member being engaged with one of the fasteners of the steel joists; and means for mechanically retaining the bridging members in engagement with the fasteners.

13. The bridging system according to claim 12 wherein the fasteners each comprise a steel dowel and wherein the means for mechanically retaining the bridging members in engagement with the fasteners comprise retaining rings.

14. The bridging system according to claim 12 wherein the fasteners each comprise a threaded member, and wherein the means for mechanically retaining the bridging members in engagement with the fasteners comprise nuts threadedly engaged with the fasteners.

15. The bridging system according to claim 12 wherein the bridging members comprise angle irons having fastener receiving holes formed in both legs thereof.

16. The bridging system according to claim 15 further characterized by bracing members connected between the bridging members.

17. The bridging system according to claim 12 wherein the fasteners are secured to the steel joists by welding.

18. In combination with a plurality of steel joists, a bridging system comprising:

a plurality of fasteners each secured at predetermined positions along the length of each of the steel joists by welding at the time the joists are manufactured;

a plurality of bridging members each comprising a length of angle iron having fastener receiving holes formed therein at equally spaced intervals;

a selected fastener receiving hole of each of the bridging members being engaged with one of the fasteners secured to one of the steel joists; and means for mechanically retaining the bridging members in engagement with the fasteners of the steel joists.

19. The bridging system according to claim 18 wherein the fasteners comprise steel dowels, and wherein the means for mechanically retaining the bridging members in engagement with the fasteners comprise retaining rings.

20. The bridging system according to claim 18 wherein the fasteners comprise threaded members, and wherein the means for mechanically retaining the bridging members with the fasteners comprise nuts threadedly engaged with the fasteners.

* * * * *